US006409647B1

(12) United States Patent
Bevins et al.

(10) Patent No.: US 6,409,647 B1
(45) Date of Patent: Jun. 25, 2002

(54) DEVICE FOR ASSEMBLING COLLAPSIBLE CONTAINERS

(76) Inventors: Earl D. Bevins, 8645 17th Ave.; Glenn E. Chernik, 120 68th Pl., both of Kenosha, WI (US) 53143

( * ) Notice: Subject to any disclaimer, the term of this patent is extended or adjusted under 35 U.S.C. 154(b) by 23 days.

(21) Appl. No.: 09/604,195

(22) Filed: Jun. 27, 2000

(51) Int. Cl.[7] ..... B31B 1/78
(52) U.S. Cl. ..... 493/309; 493/311; 493/480
(58) Field of Search ..... 493/309, 311, 493/312, 480, 315; 220/1.5, 4.29, 6; 53/381.1, 566, 564

(56) References Cited

U.S. PATENT DOCUMENTS 4,798,571 A * 1/1989 Everman et al.
4,969,861 A * 11/1990 Crittenden ..... 493/309
5,061,231 A * 10/1991 Dietrich et al. ..... 493/315
5,484,380 A * 1/1996 Bevins ..... 493/480
5,689,931 A * 11/1997 Bridges et al. ..... 493/309
6,050,063 A * 4/2000 Ford et al. ..... 53/566
6,216,899 B1 * 4/2001 Vicari ..... 220/1.5

* cited by examiner

*Primary Examiner*—Rinaldi I. Rada
*Assistant Examiner*—Sameh Tawfik
(74) *Attorney, Agent, or Firm*—Ronald P. Brockman

(57) ABSTRACT

A system for re-assembling collapsed collapsible topless containers which have four side walls pivotal to each other and a pallet. The system unfolds a collapsed container by lifting it up by one of the sides. The unfolded container is transferred to an assembling sub-unit which tips the unfolded container upright and deposits it on the pallet which releasably engages two opposing side walls.

9 Claims, 3 Drawing Sheets

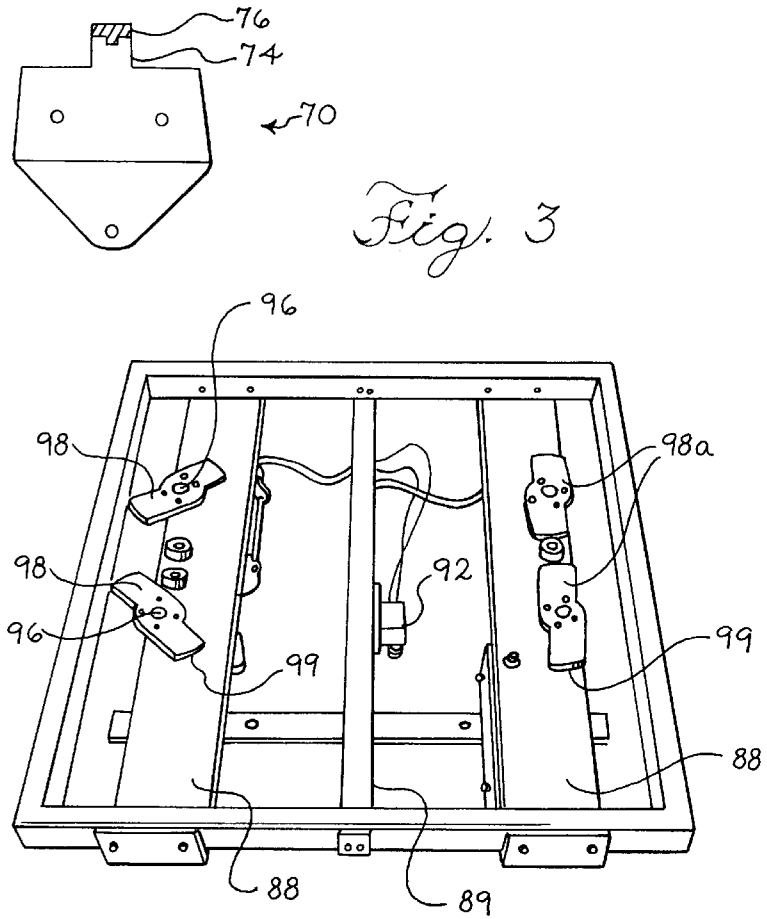
Fig. 3
Fig. 7
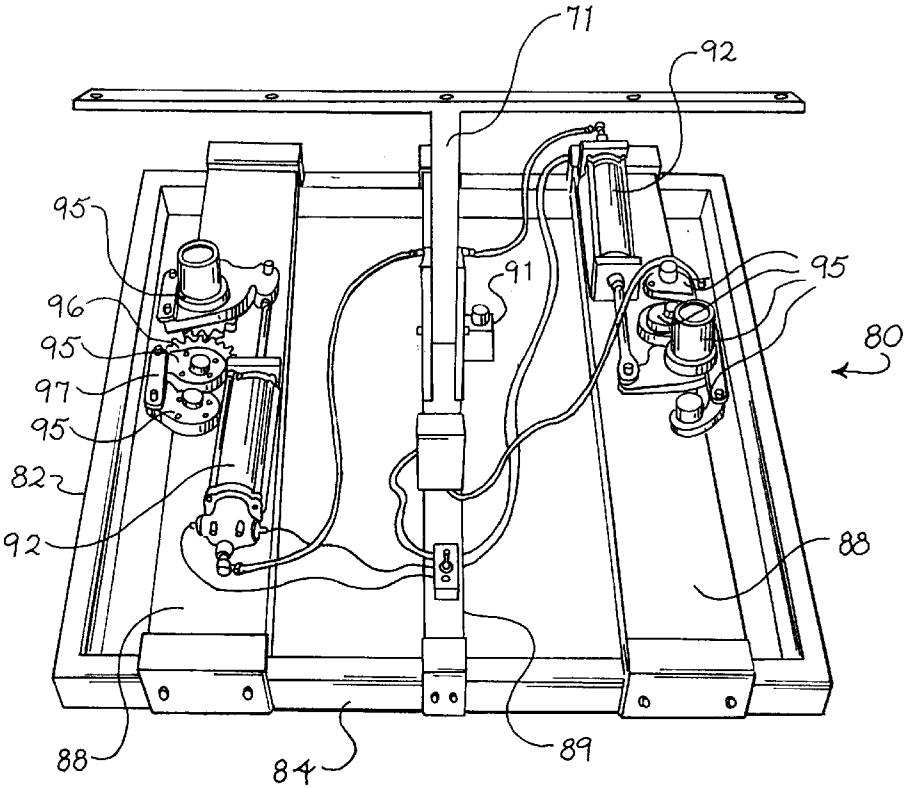
Fig. 2

DEVICE FOR ASSEMBLING COLLAPSIBLE CONTAINERS

BACKGROUND OF THE INVENTION

Certain products are suitable for being boxed and transported for further treatment. For example, some varieties of berries may be collected in large containers before they are cleaned, sorted and packaged for retail sale. The containers used in such operations are sometimes very large, occupying space which could be better utilized if the boxes could be folded and stacked during storage. In answering this need, collapsible containers have been designed such as were disclosed in U.S. Pat. No. 5,484,380. These collapsible containers are often very heavy and considerable manual labor is required to re-assemble them.

This invention relates to an improved method for handling collapsible containers of the type described in U.S. Pat. No. 5,484,380. More specifically, it involves a device and method to re-assemble collapsed collapsible topless containers which are designed to be broken down for stacking, storing, and transporting. The method consists of unfolding the collapsed container by lifting it by one of its sides and depositing the unfolded container onto a pallet, which releasibly engages two opposing side walls.

SUMMARY OF THE INVENTION

The object of the present invention is a non-manual system for manipulating collapsed collapsible topless wooden containers of the type having four sides pivotal to each other and a base. Adjacent sides of the container are hinged together by means of two or more flexible straps. In an assembled container the sides are releasably attached to the base by means of at least two sets of U-shaped clips on two opposing side walls of the container. Specifically, the system re-assembles the collapsed collapsible topless containers by unfolding the collapsed sides and placing the unfolded sides onto the base.

The system consists of an elevator-transfer sub-unit and an assembler sub-unit which act cooperatively. The elevator-transfer sub-unit has an upright element which is attached to a base element, a roller-slide device which is capable of moving up and down the upright element and a means to move the roller slide up and down. A horizontal suspension arm which is fixedly attached to the roller slide extends laterally and towards the assembler sub-unit. An inverted T-rail is pivotally attached to the suspension arm. An air driven piston/cylinder-device which connects to the T-rail and suspension arm pivots the T-rail. A trolley with at least one set of wheels runs along the T-rail. A first grasper is pivotally attached to and suspended from the trolley. The first grasper has a means to engage one side of a collapsed collapsible container releaseably.

The assembler sub-unit comprises a base member and an upright member. A horizontal arm is fixedly attached to and extends laterally from the upright member. It is directed towards the suspension arm of the elevator-transfer sub-unit. A second grasper is pivotally attached to the distal end of the horizontal arm and is capable of receiving the ends of two opposing sides of an unfolded collapsible. The second grasper engages the container, rotates 90 such it such that it is in an upright position over a base. When a container is positioned over a base, the container is released and it falls unto the base to which it is releaseably attached by U-clips. The cycle can be repeated by leaving the first grasper over a collapsed container.

BRIEF DESCRIPTION OF THE FIGURES

FIG. 2. Top perspective view of the first grasper of the invention.

FIG. 3. Perspective view of the location of the second grasper of the invention.

FIG. 7. A schematic side view of the trolley of the invention.

DETAILED DESCRIPTION OF THE INVENTION

Figure 1:
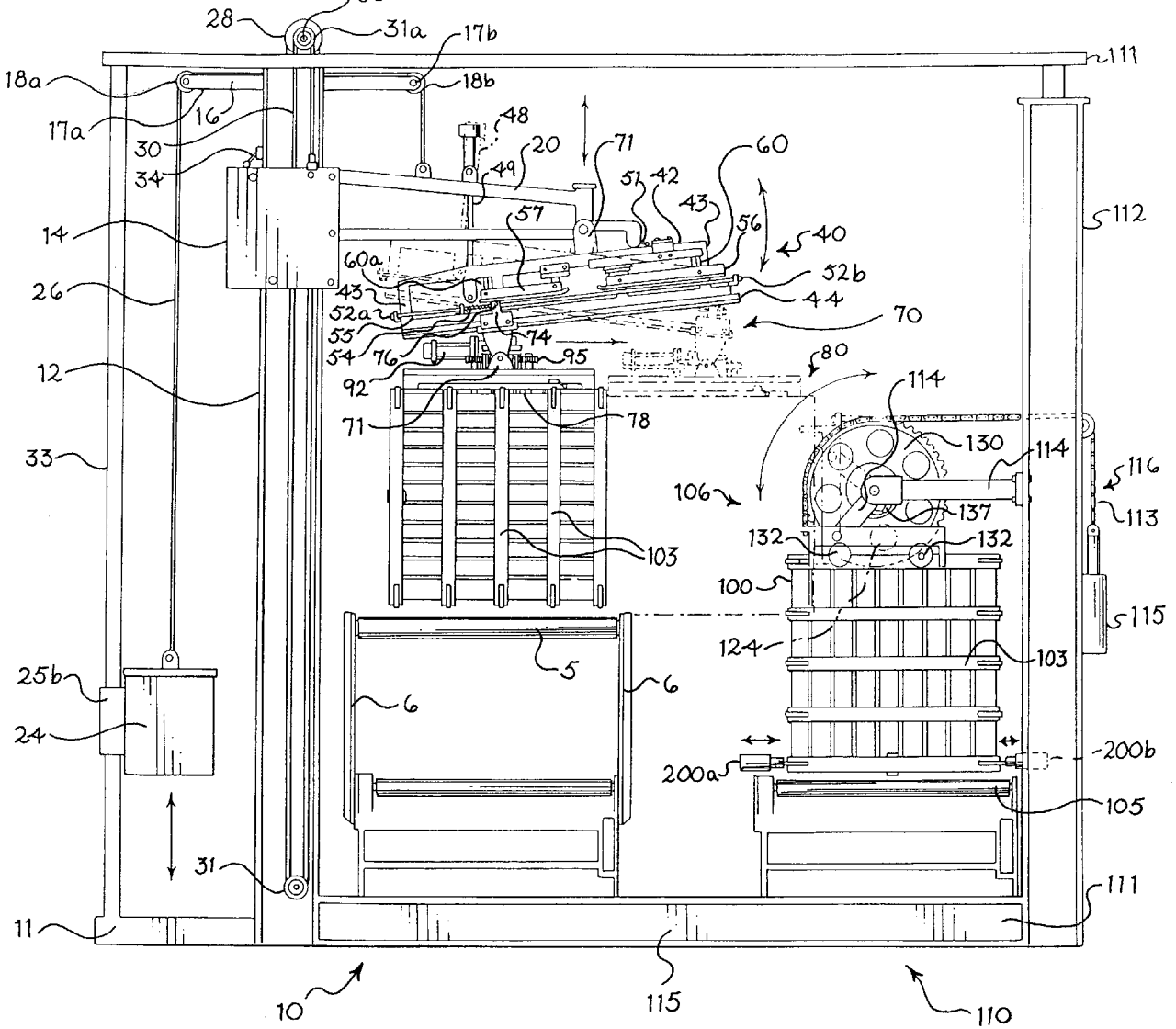
FIG. 1. Schematic side view of the apparatus that is the subject of this invention.

Referring to FIG. 1 the container assembling system of this invention has an elevator/transfer sub-unit 10 and a container assembling sub-unit 110 which interact cooperatively, and a controller unit, a power source and a compressed air source, all of which is known in the art (not shown). The elevator/transfer sub-unit 10 and the container assembling sub-unit 110 each have a base 11 & 111 and upright columnar members 12 & 112 which are of I-bar construction. The subunits 10 & 110 are connected by an upper crossbeam 110 which connect the upright columnar members 12 & 112 and a lower base beam 115 which joins the bases 11 & 111. A catwalk (not shown) may ride on the upper crossbeam 111.

The elevator/transfer sub-unit 10 has a roller slide device 14 which is known in the art and which is capable of moving up and down the first upright columnar member 12. A first pulley 31 is attached to the lower portion of the first upright columnar member 12.

A power driven motor 28 with a shaft 33 is fixedly attached to the first columnar member 12. A motor pulley 31*a* is located on the shaft. A driver chain 30 is attached by both ends to the roller slide device 14 and is suspended between motor pulley 31*a* and the lower pulley 31. The power driven motor 28 is connected to and controlled by a controller (not shown). A horizontal balance beam 16 is fixedly attached to the top of the first upright columnar member 12. The horizontal balance beam 16 has first 17*a* and second 17*b* ends. Second pulleys 18*a* and 18*b* are attached to the first and second ends 17*a* and 17*b* of the balance beam 16.

The roller slide device 14 has a triangular suspension arm 20 which is made of metal box tubing. The arm 20 extends laterally towards the container assembling sub-unit 110. A cable 26 which is suspended from the second pulleys 17*a* & 17*b* connects the triangular suspension counterweight 24. An upright guide 33 which runs parallel to the first upright columnar member 12 is attached between the balance beam 16 and base 11. They pass through apertures 25*b* in the counterweight 24 as shown in FIG. 1.

A first contract switch 34 which is capable of engaging the roller slide 14 is attached near the top of the upright columnar member 12. The first contact switch 34 is connected to the controller unit (not shown). A sensor 51 capable of being activated by contact is located on the distal end of the triangular suspension arm 20.

A trolley/rail system 40, which is a rectangular structure consisting of an upper bar 42 and a lower inverted T-rail 44 and connecting members 43, is pivotally attached to the suspension arm 20 as shown in FIG. 1. The inverted T-rail 44 may be box tubing. A first air driven piston/cylinder device 48 is fixedly attached to the upper bar 42. The piston rod 49 of the device 48 is connected to the upper bar 42. Trolley stop members 52*a* & 52*b* are fixedly attached to each end of the T-rail 44. Guide rods 55 run on each side of the T-rail 44, extending between the stops 52*a*, 52*b*. A spiral spring member 54, which is capable of cushioning a trolley 70 upon impact, is located distally to the proximal trolley stop member 38 around the guide rod 54.

A first brake mechanism 56 is attached to the distal half of the trolley/rail system 40. The brake mechanism 56 is of angle iron construction whose proximal end 57 is pivotally attached to the upper bar 42. Its distal end 58 is attached via a biased air cylinder/piston mechanism 60, which is known in the art, to the upper bar 42. In the preferred embodiment a second brake mechanism 57 is attached to the trolley/rail system 40 to provide braking proximally. It is attached in a manner that is a mirror image of the first brake mechanism 56.

A trolley 70 with at least one pair of wheels 72 is suspended on the T-rail 44. The trolley 70 has a plate member 74 extending upwardly sufficiently to engage the brake mechanisms 56 & 57. Referring to FIG. 7, a teflon block 76 is embedded in the top of the plate member 74 and is capable of engaging the brake mechanisms 56 & 57. Referring to FIG. 1 a roller 5 is supported by two roller supports 6 which are attached to and extend upwardly from the first base 11 and acts to keep a container 100 which is suspended from the first grasper 80 from swaying. It is located off-center sufficiently to accommodate the container and is oriented parallel to the lower base beam 115.

A first grasper 80 is pivotally attached to the trolley 70 by a connecting member 71. Referring to FIG. 2 the first grasper 80 is a rectangular frame structure with two long sides 84 and two short sides 86 Which support two crossbeams 88 and a central beam 89. The central beam 89 is fixedly attached to the connecting member 71 as shown in FIG. 2. Third air driven cylinder/piston members 92 are attached to the upper sides of the crossbeams 88.

Figure 4:
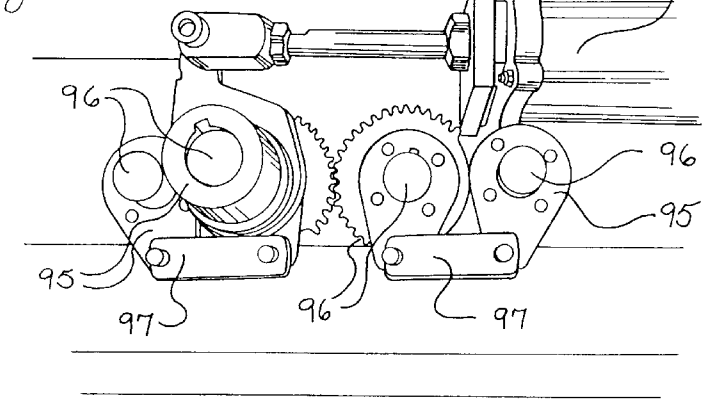
FIG. 4. Broken away view of the camming device located on the bottom side of the first grasper.

Referring to FIG. 4 camming devices 94, which are sets of four wheels 95 arranged in series, are attached to the crossbeams 88 by shafts 96 which extend through the crossbeams 88. The second wheel 95 is attached to the piston of the third air driven piston/cylinder members 92. The second and third wheels 95, which are cogged, of the camming devices 94 interact with each other by cogs 96. The first and fourth wheels 95 are connected to the second and third wheels 95, respectively, by metal plates 97. The first and fourth wheels 95 are connected to second cams 98 on the underside of the cross beams 88 as shown in FIG. 3 by their shafts 96. The second cams 98 are shown in both engaging 98 and disengaging 98*a* positions with respect to a side of a collapsed container in FIG. 3.

The cam faces 99 of the second cams 98 have convexedly curved configurations adapted to engage with upwardly directed slats 103 of the collapsible container 100. The leading surfaces 101 of the cam faces 99 have a greater radius than the trailing surfaces 102. Referring to FIG. 3 a contact switch 91, including a switch actuator, which is known in the art, moveable between open and closed positions is located on the underside of the central beam 89.

Referring to FIG. 1 sub-unit 110 consists of a second upright columnar member 112 on a base 111. The second upright columnar member 112 supports an arm 114 which extends horizontally towards the first grasper 80. A second grasper 116 is pivotally attached to the distal end of the arm 114 by a second camming device 130. The camming device 130 is attached by a chain 113 to a fourth air driven piston/cylinder assembly 115 which is fixed attached to second upright columnar number 112.

Figure 5A:
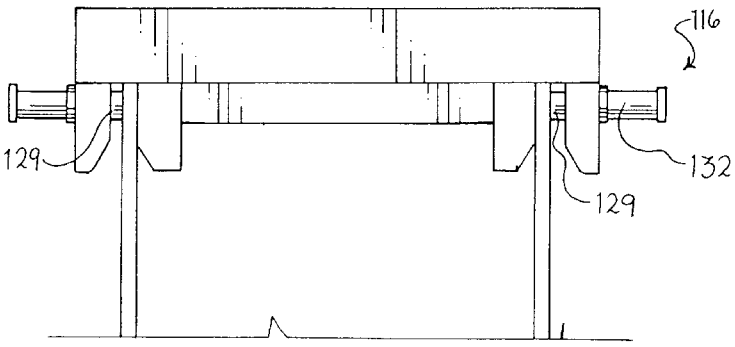
FIG. 5. A side view of the second grasper of the invention.
Figure 5B:
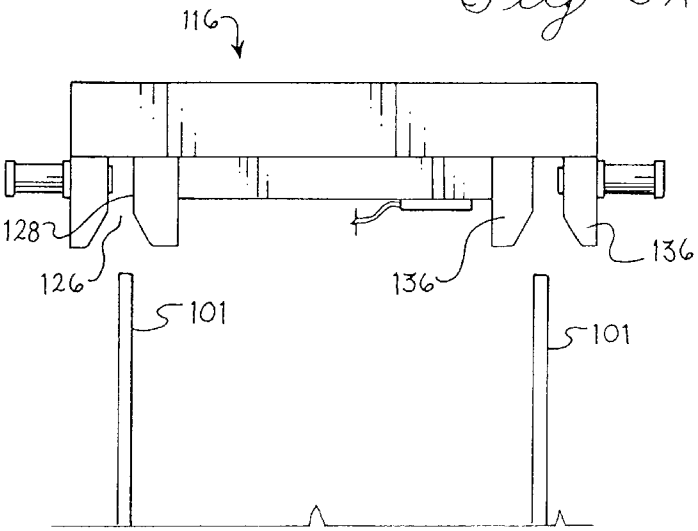
Figure 6:
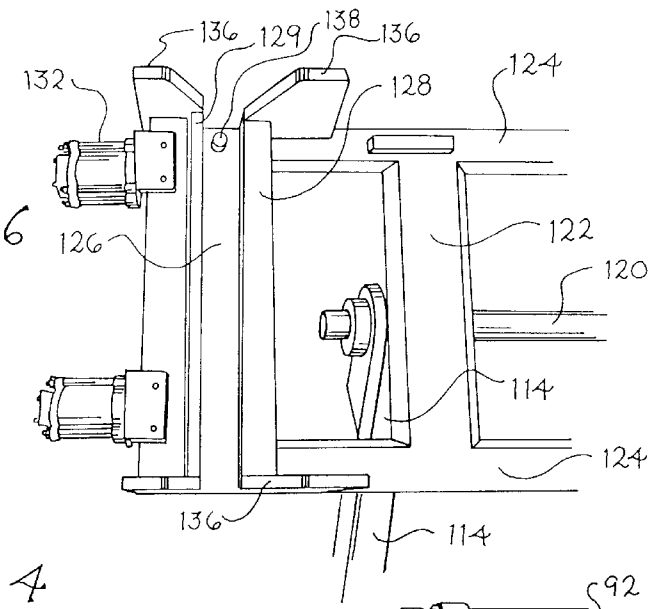
FIG. 6. Partial broken away view of the second grasper of the invention.

The second grasper 116 is shown in FIG. 5 and 6. It has a grasper shaft 120 which supports two short support bars 122 which are suitably spaced parallel to each other. The short 122 support bars support two longitudinal frame member 124 that extend beyond the points of attachment to the short support bars 122. The short support bars 124 are fixedly attached to the two longitudinal frame members 124. The longitudinal frame members 124 support a pair of spaced channels 126, each channel 126 being for by a fixed flange 128. The spaced channels 126 are capable of receiving opposing sides 101 of the uncollapsed collapsible container 100. The moveable flange 129 is attached by a fifth air driven piston/cylinder device 132 at grasper end plate 134. Lateral guide plates 136 are fixedly attached to the ends of the fixed flange 128 and grasper and plates 134. The spaced channels 126 are sufficiently wide to receive the ends of side walls 101 of a collapsible container 100. The fifth piston/cylinder device 132 is connected to and controlled by a controller unit (not shown) which is known in the art. A contact switch 138 is located in one spaced channel 126 and connected to the controller unit (not shown). It is actuated by contact with a side wall 101 of container 100.

A pair of compressing piston/cylinder devices 200*a* & 200*b* are located on the lower base beam 115. The piston head 201 is tapered inwardly and downwardly so as to push the two sides 101 of the container 100 inwardly. They are spaced to receive an unfolded collapsible container 100.

In the operation of the container assembling system, when the machine is turned on, the driver motor 28 drives the driver chain 30 to lower the roller slide 14. This causes the first grasper 80 to come in contact with a collapsed container 100. Contact switch 91 is activated by contact with the container 100. This activates the third piston/cylinder member 92 to cause the cam device 94 to be activated thereby causing the cam faces 99 to engage container 100 by its slots 103. After a delay relay to the driven motor 28, it is activated to move the driven chain 30 and raise the roller slide 14.

When the switch 91 is activated air enters the piston/cylinder member 92, thereby moving the wheels of camming device 94 causing them to rotate. The rotation of the cam causes interconnected wheels to rotate thereby causing the camming faces 99 of second cam members 98 to engage opposing sides of adjacent slats 103 of a collapsed collapsible container 100.

When the collapsed collapsible container 100 is fully engaged by the second cams 78 the power driven motor 28 is activated as a result of time delay relay which is known in the art. This causes the driver chain 30 to lift the roller slide 14. As the roller slide 14 moves upwardly the collapsed container 100 unfolds. At the top of the lifting cycle the roller slide 14 engages contact switch 34. Upon contact the switch is activated causing the power to the driven motor 28 to be turned off and causing first piston/cylinder device 48 to lift the trolley/rail system. The force of gravity causes the trolley to move to the distal end of the T-rail 44 causing the container 100 to engage a second grasper 116 of sub-unit 110. Specifically, the ends of the side walls 101 enter the spaced channels 126.

The contact switch 138 is activated thereby causing the fifth air driven piston/cylinder devices 132 to move the movable flange 129 toward to engage the container 100 which lies in the spaced channels 126. After a suitable time delay by means known in the art the fourth air driven piston/cylinder assembly 115 is activated to allow the second grasper 110 with container 100 to rotate 90 degrees whereby a third contact switch 137 is engaged. This activates the fifth piston/cylinder devices 132 to move the moveable flange 129 back thereby releasing the container 100, allowing it to fall onto the pallet base 105. Two opposing sides 102 engage the compressing pistons/cylinder devices 200*a* and *b* causing the sides to move inwardly, allowing the U-clip (not shown) of the container 100 to engage the pallet base 105, when the pressure is released after a time delay. The second grasper 116, after a time delay rotates 90° to its resting position by action of the fourth air driven piston/cylinder device 115. This disengages third contact switch 137. At the same time the driver motor 28 is activated to lower the roller slide 14 (the start of a new cycle).

We claim:

1. In a collapsible container having side walls which are pivotal with respect to one another, having no top and a detachable base pallet, the base pallet having a ridge means to receive the walls of the container, wherein the later is secured to the sidewalls by means of a pair of clips, a clip being permanently affixed to each of a pair of opposite walls and engaging the base pallet through openings in corresponding opposing base pallet ridges, a system for manipulating collapsible containers which unfolds collapsed containers and places them on base pallets, the system comprising:

a. first and second bases;

b. a first upright support member supported by the first base;

c. a roller slide member supported on and movable up and down the first upright support member;

d. a motor means which is capable of moving the roller slide up and down the support member;

e. a switch engagable by the roller slide mounted on the first upright support member;

f. a first horizontal arm fixedly attached to the roller slide and directed towards the second base member;

g. a rail member pivotally attached to the first horizontal support arm, the rail member comprising a first frame, an inverted T-rail being supported by and suspended from the first frame and having a riding surface on each side;

h. a tilting means which is mounted between and to the first horizontal arm and rail member;

i. a trolley means suspended from and movable along the riding surfaces of the T-rail;

j. first and second braking means mounted on the ends of the rail member;

k. a first grasper capable of releasibly engaging a sidewall of a collapsed collapsible container attached to the trolley member, the first grasper comprising a first grasper frame, a grasping means mounted on the underside of the first grasper frame, a second contact switch capable of being engaged by a wall of the collapsed collapsible container attached to the underside of the grasper frame;

l. a second upright member supported by the second base;

m. a second lateral arm mounted on the second upright support member and directed towards the first horizontal arm;

n. a second grasper mounted on the distal end of the lateral arm, the second grasper comprising a frame, a grabbing means mounted on the frame, the grabbing means being capable of releasibly receiving an unfolded container from the first grasper, a third contact switch capable of being engaged by a collapsed collapsible container and activating the grasper;

o. a means to pivot the second grasper being mounted on the second upright support member;

p. a sensor means capable of detecting that the second grasper has pivoted downwards.

2. In the system of claim 1 wherein a guide rail is supported on each side of the inverted T-rail by the first and second stop and runs above the riding surface, a compression spring capable of resisting the movement of the trolley means is supported around the proximal end of each guide rail, and braking means are mounted on the ends of the rail member, the braking means comprising an air driven piston-cylinder means mounted on the first frame, an elongated metal plate which is pivotally attached to the first frame proximally and attached to the first frame distally via the air driven piston-cylinder means.

3. The system of claim 1 wherein the motor means comprises a motor having a rotatable drive shaft; a first cog pulley mounted on the upper drive shaft; a second cog pulley mounted on the upright support member; a driver chain attached at both ends to the roller slide member and rotatably mounted on the first and second cog pulleys.

4. The system of claim 1 wherein the first grasper frame; at least one set of camming devices mounted on the frame; each set of camming devices having cams capable of frictionally engaging a sidewall of a collapsible container; air driven piston-cylinder devices mounted on the frame and connected to the camming devices and a sensor means mounted on the frame to activate the air driven piston-cylinder devices and motor means.

5. The system of claim 1 wherein the second grasper comprises a second grasper frame which is pivotally attached to the second support arm; a pivoting means mounted on the frame, two space channels capable of receiving respective ends of a opposing sidewalls of the container being mounted on each side of the frame; the channels having movable and non-movable side plates, at least one first air driven piston-cylinder device mounted on the frame and connected to the movable plate; a first switch to activate air driven piston-cylinder device and a second switch to activate the first air driven piston-cylinder device to disengage the container.

6. The system of claim 5 wherein the pivoting means comprises a second air driven piston-cylinder device mounted on the second upright support member and connected to a camming device and a means to connect the second air driven piston-cylinder device to the camming device.

7. The device of claim 1 wherein a base connector connects the first and second bases and a connecting frame member connects the first and second upright support members.

8. The device of claim 1 wherein a balance beam is mounted on the top of the first upright support member, first and second pulleys are mounted on the support beam, a cable is attached to the roller slide, the cable being suspended on the two pulleys mounted on the support beam and the cable supports a counter-weight.

9. In a collapsible container having side walls which are pivotal with respect to one another, having no top and a detachable base pallet, the base pallet having a ridge means to receive the walls of the container, wherein the later is secured to the sidewalls by means of a pair of clips, a clip being permanently affixed to each of a pair of opposite walls and engaging the base pallet through openings in corresponding opposing base pallet ridges, a system for manipulating collapsible containers which unfolds collapsed containers and places them on base pallets, the system comprising:

a. first and second bases;

b. a first upright support member supported by the first base;

c. a roller slide member supported on and movable up and down the first upright support member;

d. a motor means which is capable of moving the roller slide up and down the support member;

e. a switch engagable by the roller slide mounted on the first upright support member;

f. a first horizontal arm fixedly attached to the roller slide and directed towards the second base member;

g. a rail member pivotally attached to the first horizontal support arm, the rail member comprising a first frame, an inverted T-rail being supported by and suspended from the rail and having a riding surface on each side;

h. a tilting means which is mounted between and to the first horizontal arm and rail member;

i. a trolley means suspended from and movable along the riding surfaces of the T-rail;

j. first and second braking means mounted on the ends of the rail member;

k. a first grasper capable of releasibly engaging a sidewall of a collapsed collapsible container attached to the trolley means, the first grasper comprising a first grasper frame, a grasping means mounted on the underside of the first grasper frame, a second contact switch capable of being engaged by a wall of the collapsed collapsible container attached to the underside of the grasper frame, at least one set of camming devices mounted on the frame, each set of camming devices having cams capable of frictionally engaging a side wall of a collapsible container, air driven piston-cylinder devises mounted on the frame and connected to the camming devices and a sensor means mounted on the frame capable of activating the air driven piston-cylinder devices and the motor means;

l. a second upright member supported by the second base;

m. a second lateral arm mounted on the second upright support member and directed towards the first horizontal arm;

n. a second grasper mounted on the distal end of the lateral arm, the second grasper comprising a second grasper frame which is pivotally attached to the second support arm, a pivoting means mounted on the frame, two space channels mounted on the opposite sides of the frame and capable of receiving respective ends of opposing side walls of the container, the channels having movable and non-movable side plates, at least one first air driven piston-cylinder member mounted on the frame and connected to the movable plate, a first switch to activate air driven piston-cylinder device and a second switch to activate the air driven piston-cylinder member;

o. a means to pivot the second grasper being mounted on the second upright support member;

p. a sensor means capable of detecting that the second grasper has pivoted downwards.

* * * * *